United States Patent [19]

Buchser

[11] Patent Number: 4,715,512

[45] Date of Patent: Dec. 29, 1987

[54] INSULATED CABINET MANUFACTURE

[75] Inventor: William J. Buchser, Marrs Township, Posey County, Ind.

[73] Assignee: Whirlpool Corporation, Benton Harbor, Mich.

[21] Appl. No.: 299,037

[22] Filed: Sep. 3, 1981

[51] Int. Cl.[4] ..... F25D 23/08

[52] U.S. Cl. ..... 220/465; 220/467; 277/177; 312/214

[58] Field of Search ..... 220/444, 465, 467; 16/2; 174/153 G; 277/177, 176, 182, 183, 189, 1, 3, 27, 237; 312/214

[56] References Cited

U.S. PATENT DOCUMENTS

| | | | |
|---|---|---|---|
| 970,095 | 9/1910 | McPheeters | 220/465 X |
| 1,890,348 | 12/1932 | Weatherhead, Jr. | 174/153 G X |
| 2,134,302 | 10/1938 | Haushalter | 277/237 X |
| 2,343,440 | 3/1944 | Andrus | 220/465 X |
| 2,403,813 | 7/1946 | Manderscheid | 16/2 X |
| 2,583,719 | 1/1952 | White | 16/2 X |
| 2,799,528 | 7/1957 | Wilfert | 174/153 G X |
| 2,919,147 | 12/1959 | Nenzell | 220/378 X |
| 2,921,819 | 1/1960 | Rifkin | 16/2 X |
| 3,247,999 | 4/1966 | Stilwell | 220/465 |
| 3,424,857 | 1/1969 | Miller et al. . | |
| 3,440,308 | 4/1969 | Carbary et al. . | |
| 3,502,917 | 3/1970 | Bizoe | 174/153 G X |
| 3,619,482 | 11/1971 | Boor . | |
| 3,874,677 | 4/1975 | Ludwig et al. | 277/27 |
| 3,887,960 | 6/1975 | Sherman | 174/153 G X |
| 4,118,451 | 10/1978 | Schaus . | |
| 4,134,627 | 1/1979 | Kuskowski | 312/214 |
| 4,163,136 | 7/1979 | Piber | 174/153 G X |
| 4,165,105 | 8/1979 | Hahn . | |
| 4,180,297 | 12/1979 | Abrams . | |
| 4,186,945 | 2/1980 | Hahn . | |
| 4,411,439 | 10/1983 | Couvillion et al. | 227/27 X |

FOREIGN PATENT DOCUMENTS

| | | | |
|---|---|---|---|
| 262532 | 12/1926 | United Kingdom | 174/153 G |

*Primary Examiner*—Henry J. Recla
*Assistant Examiner*—Robert M. Petrik
*Attorney, Agent, or Firm*—Wood, Dalton, Phillips, Mason & Rowe

[57] ABSTRACT

An insulated cabinet manufacture for use in a refrigeration appliance or the like, having an outer shell and an inner liner with foamed-in-place insulation therebetween. A wiring tunnel is extended inwardly through an opening in the shell, through the insulation space, and inwardly through an aligned opening in the liner. The opening in the liner may be substantially larger than the periphery of the wiring tunnel and a foam stop element is affixed to the inner surface of the liner with the wiring tunnel extending therethrough. A second foam stop element is loosely disposed on the wiring tunnel to be moved into engagement with the first stop element as an incident of the foaming of the insulation material during the foaming-in-place operation. The outer end of the wiring tunnel may be provided with a flange sealingly secured to the outer surface of the shell. A wiring harness is removably installed in the tunnel to provide wiring from exteriorly of the cabinet to the interior thereof.

9 Claims, 3 Drawing Figures

FIG. 1
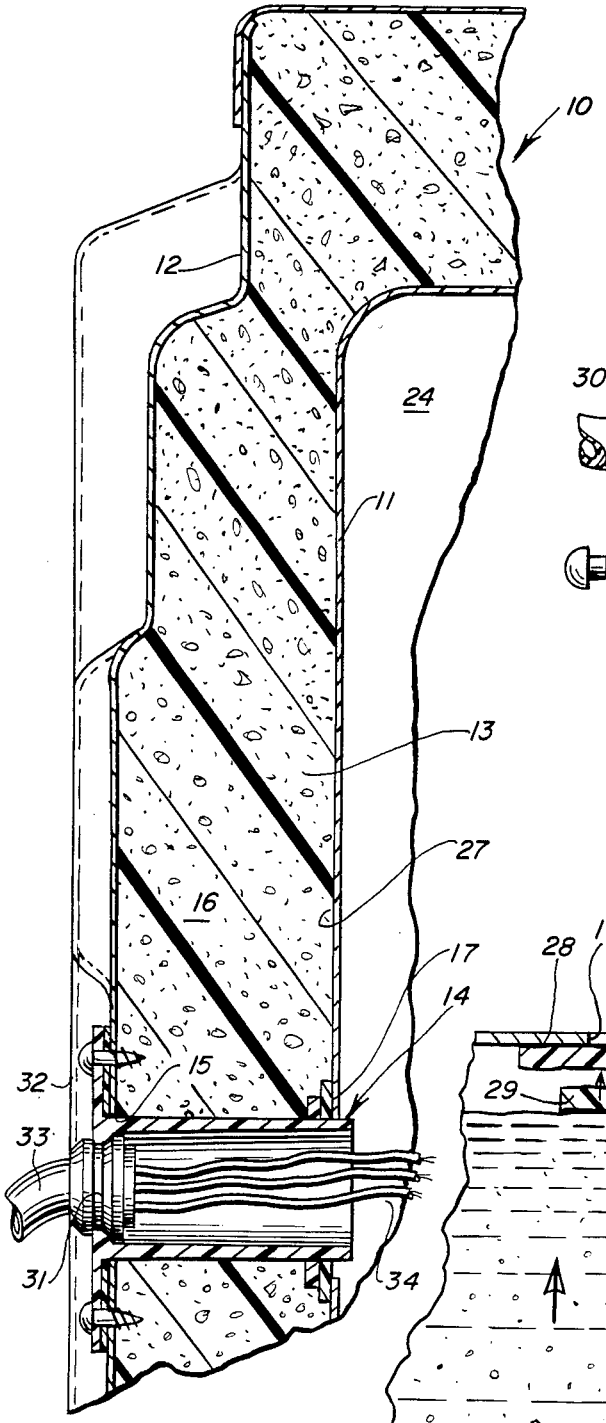
FIG. 2
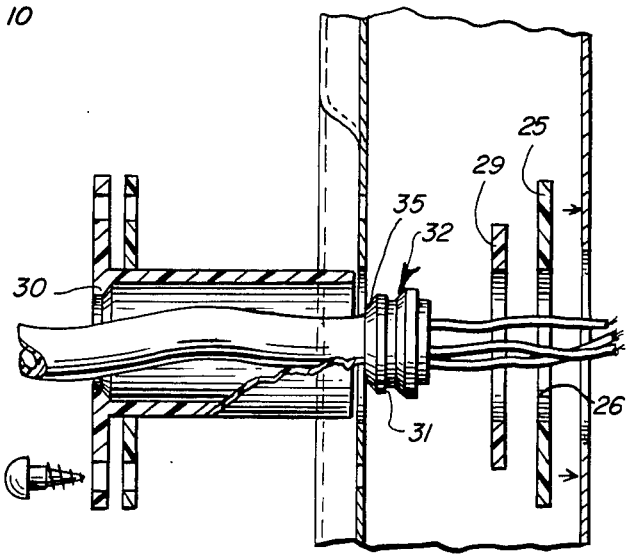
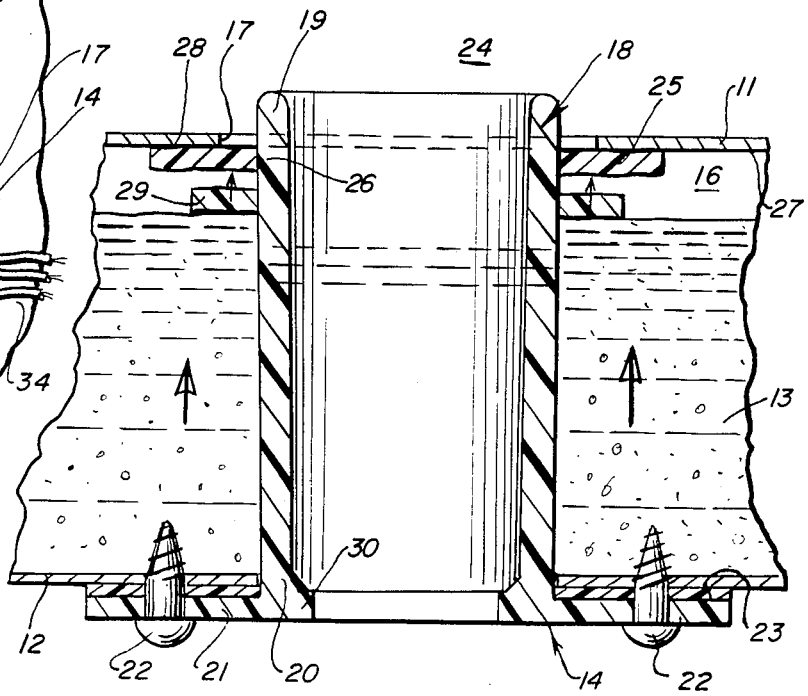
FIG. 3

INSULATED CABINET MANUFACTURE

BACKGROUND OF THE INVENTION

1. Field of the Invention

This invention relates to insulated cabinet construction, and in particular to an insulated cabinet construction and method of assembly wherein a tubular member extends therethrough and includes means for preventing the escape of foamed-in-place insulation at an opening in one of the wall elements of the cabinet.

2. Description of the Background Art

In one conventional method of forming a refrigerator cabinet, a liner is spaced from a shell and foamed-in-place insulation is formed therebetween. To provide electrical power to electrical apparatus within the refrigeration cabinet, a wiring tunnel is extended through the cabinet. A problem arises in the provision of such through-the-cabinet structure in that the expanding foam insulation tends to escape through any opening in the shell or liner. To prevent such escape, foam stop means are provided for stopping the foaming action at the opening. The present invention is concerned with a wiring tunnel arrangement having an improved foam stop means for effectively preventing the escape of foam material through wiring tunnel openings provided in the shell and liner of the cabinet assembly.

A number of different devices have been developed for passing wiring through panels and insulated wall members. Illustratively, in U.S. Pat. No. 3,424,857 of Hubert B. Miller et al, a wiring grommet is installed in a panel by means of a circular groove surrounding the outer periphery of the grommet. In the Miller et al grommet, an internal cylindrical groove is provided near the outer periphery of the grommet to permit controlled collapsing for facilitated insertion of the grommet in the circular panel hole.

Richard J. Carbary et al, in U.S. Pat. No. 3,440,308 shows a check valve structure arranged to permit the entrance of the foam injection conduit and which responds to the internal pressure caused by the foaming of the insulation to shut off the conduit entrance opening.

Roger M. Boor, in U.S. Pat. No. 3,619,482, shows a wiring tunnel having its opposite ends fastened to the liner and shell of the cabinet respectively. The wiring tunnel support has a protrusion extending through an opening in the liner. Another sheet metal wall is secured to an external flat surface on the protrusion so as to be spaced from the liner.

John J. Schaus shows, in U.S. Pat. No. 4,118,451, which patent is owned by the assignee hereof, a foam stop comprising a flexible sheet secured to one or the other of the liner or shell, permitting the foaming insulation to lift the projecting portion of the sheet so as to cause it to extend across an opening from the insulation space and thereby close that opening. A backup member is disposed across the opening to limit the outward deflection of the sheet by the foam.

In U.S. Pat. No. 4,165,105, Thomas M. Hahn shows a transition sleeve for a refrigerator cabinet. The sleeve is defined by a tubular body of relatively rigid material and includes radially extending integral flanges at each end for sealing engagement with the shell and liner of the cabinet. The sleeve is rotatable in one of the walls by means of integral locking tabs. Refrigerant tubing extends through the sleeve and is sealed thereto by gum or the like.

A sealing grommet for use in refrigerator cabinets is disclosed in U.S. Pat. No. 4,180,297 of Donald W. Abrams. The sealing grommet provides a seal for electrical wires and is defined by a cylindrical hollow body of rigid material having a core of soft material glued to the outer body. Each of the body and core is split longitudinally to receive the electrical wires. A second grommet engages the core so as to seal the core to the shell. An integral annular flange is provided with locking lugs to mount the body on the inner liner of the cabinet.

Another transition sleeve structure is illustrated in U.S. Pat. No. 4,186,945 of Thomas M. Hahn. The sleeve includes annular flanges which are flared outwardly to sealingly engage the shell and liner. The insulation foam is caused to act against the convex portion of the flange to enhance the sealing force.

SUMMARY OF THE INVENTION

The present invention comprehends an improved insulated cabinet construction and method of assembly having improved foam stop means in association with means defining a wiring tunnel through the cabinet structure.

More specifically, the invention comprehends providing a wiring tunnel member to extend through aligned openings in the outer shell and inner liner of the cabinet, with a first foam stop member mounted to the surface of the liner confronting the insulation space. A second foam stop member is movably mounted about the wiring tunnel so as to be urged by the foaming insulation toward the first foam stop member and into engagement therewith to provide a double foam stop system.

The outer end of the wiring tunnel member may be sealingly fixedly secured to the shell. The opening in the liner may be relatively large, permitting free extension of the tunnel therethrough as the novel foam stop arrangement of the invention accommodates misalignment of the wiring tunnel member relative to the liner opening while yet assuring positive stopping of the foam at the opening during the foaming process.

In broadest aspect, the novel manufacture may be effected with a single foam stop member carried by the liner wall. In the illustrated embodiment, the second foam stop member is movably mounted about the wiring tunnel prior to the insertion of the inner end of the wiring tunnel through the foam stop member affixed to the liner wall.

A sealing gasket may be provided for sealing the outer end of the wiring tunnel element to the shell and in the illustrated embodiment, the outer end of the wiring tunnel element is provided with a radial flange, with the sealing gasket disposed between the flange and the outer surface of the shell in the secured arrangement of the structure.

The invention also comprehends a method of assembling a foamed-in-place refrigerator cabinet structure including an outer shell and an inner liner with a through-the-wall wiring structure therein, comprising the steps of providing a liner, forming an opening in the wall of the liner, securing a foam stop member on the outer surface of the portion of the liner defining the opening, the foam stop member having an inner portion overlying the opening and defining an opening, providing a shell, forming an opening in the wall of the shell, extending a rigid tubular member inwardly through the shell wall opening, placing the liner within the shell in spaced, nested relationship to form an insulation space therebetween and with the tubular member extending inwardly successively through the foam stop and liner opening, and forming foam-in-place insulation in the insulation space.

While the illustrated embodiment is concerned with the provision of a wiring structure in a refrigerator cabinet, as will be obvious to those skilled in the art, the invention broadly comprehends the method of effecting controlled foaming of foam-in-place insulation at an opening in a boundary wall member.

The invention comprehends the arrangement of the wall members so that the insulation foams upwardly against the underside of the movable foam stop on the insert so as to urge the second foam stop upwardly against the first foam stop affixed to the first wall, thereby providing an improved double foam stop system.

The cabinet manufacture of the present invention is extremely simple and economical while yet providing an improved arrangement wherein the foaming insulation is effectively prevented from passing outwardly through the wall member openings. As will be described, an important advantage of the present invention is that it permits a refrigerator cabinet to be assembled with minimum tolerance requirements and, thus, at relatively low cost.

BRIEF DESCRIPTION OF THE DRAWING

Other features and advantages of the invention will be apparent from the following description taken in connection with the accompanying drawing wherein:

FIG. 1 is a fragmentary vertical section of an insulated cabinet construction embodying the invention;

FIG. 2 is a fragmentary exploded section thereof; and

FIG. 3 is a fragmentary enlarged section illustrating the method of effecting the dual foam stop manufacture embodying the invention.

DESCRIPTION OF THE PREFERRED EMBODIMENT

In the exemplary embodiment of the invention as disclosed in the drawing, a cabinet construction generally designated 10 is shown to comprise an insulated wall structure defined by a first, inner wall member 11, a second, outer wall member 12, and a body of foamed-in-place insulation 13 therebetween. In the illustrated embodiment, the cabinet comprises a refrigerator cabinet wherein the inner wall member 11 comprises the liner, and the outer wall member 12 comprises the shell of the cabinet.

The present invention is concerned with the provision of means extending through the cabinet construction, and more specifically, in the illustrated embodiment, is concerned with the provision of a wiring tunnel 14 extending therethrough. Thus, as shown in FIG. 1, the wiring tunnel comprises an insert extending inwardly through an opening 15 in the shell 12 through the insulating space 16 between the shell and liner, and inwardly through an opening 17 in the liner.

The wiring tunnel, as best seen in FIG. 3, is defined by a tubular wall member 18 having an inner distal end 19 and an outer end 20 provided with a radially outturned annular flange 21. Flange 21 is secured to the shell 12 by suitable means, such as screws 22 and is sealed to the shell by a suitable annular gasket 23.

As shown in FIG. 3, liner opening 17 is substantially larger than the outer diameter of tunnel portion 19 so that precise lateral alignment of the liner 11 and shell 12 are not required during assembly of the cabinet 10. Also as shown in FIG. 3, the length of the wiring tunnel is made sufficiently long so as to ensure that its distal end 19 extends well beyond the liner 11 into the interior cabinet space 24. This allows the tunnel to serve as a locating means when assembling the liner 11 and shell 12 in nested relationship prior to foaming, and obviates the need for precise spacing between these components.

As indicated above, the present invention is concerned with the problem of preventing insulating foam from escaping from insulation space 16, as through opening 17, during foaming of the cabinet 10. As shown in FIG. 3, a first foam stop 25 is disposed adjacent liner 11 and defines a center opening 26 which is smaller than opening 17 so as to overlap the opening 17 and have a general fit with the periphery of the wiring tunnel tubular wall 18. In the illustrated embodiment, the foam stop 25 comprises a thin, annular element formed of flexible open cell polyurethane foam, and the center opening 26 has a diameter slightly smaller than that of the tubular wall 18. Foam stop 25 may be secured to the outer surface 27 of the liner by suitable means, such as adhesive 28. Open cell polyurethane foam is particularly well suited for use as the foam stop 25 because it will deform to fit closely about the tubular member 18 and because it tends to kill the expansion of that portion of the foam resin that it contacts.

A second foam stop 29 is movably mounted about the tunnel portion 18 and may be similarly formed of open cell polyurethane foam. Thus, foam stop 29 is freely longitudinally movable on the tunnel portion 18 so as to be readily moved into engagement with the first foam stop 25 in the assembled arrangement of the structure as shown in FIG. 1.

As illustrated in FIG. 3, the foaming operation may take place with the shell 12 lowermost so that the expanding foam insulation 13 rises toward the liner 11 carrying with it the freely movable second foam stop 29, as indicated by the arrows in FIG. 3. Thus, as the insulation rises, it brings the foam stop 29 into engagement with foam stop 25, which cooperate to define a double foam stop system effectively preventing passage of foam material outwardly through opening 17. Although in the illustrated embodiment the cabinet 10 is foamed with the shell 12 lowermost, it has been found that the invention can also be practiced when the cabinet is foamed in a face-down position, with liner 11 lowermost.

As further shown in the drawing, tubular portion 18 of the tunnel element defines, at outer end 20, a flange 30 extending radially inward and adapted to have snap-fitting relationship with a peripheral groove 31 of a grommet 32 at the end of a wiring conduit 33, in which is provided a plurality of wires 34. Thus, the wires 34 may be brought inwardly through the wiring tunnel into the cabinet space 24 for connection to electrical apparatus therein, as desired. As shown in FIG. 2, the grommet may be arranged with camming surface 35 for guiding the grommet outwardly against the wiring tunnel flange 30 to facilitate the snap-on mounting of the grommet to the flange 30.

The gasket 23 and grommet 32 cooperate with the outer end portion 20 of tubular member 18 to form a seal that effectively prevents moisture, usually in the form of water vapor, from entering the insulation space 16 or the cabinet interior space 24. This moisture seal, established in relation to shell 12, eliminates the need for a further moisture seal adjacent the distal, inner, end 19 of tubular member 18.

In the illustrated embodiment, the wiring tunnel is formed of a synthetic resin, such as relatively rigid polyvinyl chloride, and the grommet 32 is formed of a somewhat more resilient material, such as a lower durometer polyvinyl chloride. The gasket 23 may be formed of a closed cell polyethylene foam.

It will be appreciated that the invention comprehends not only the above described cabinet assembly but also the cabinet assembly method disclosed herein. Namely, the invention comprehends the assembly of an insulated cabinet structure by forming corresponding openings in wall portions of a cabinet liner and shell, securing a foam stop member on the outer surface of the liner overlying the opening, mounting a tubular member to the shell such that the member extends inward through the shell opening, placing the liner and shell in spaced, nested relationship with the tubular member extending through the foam stop element and through the liner opening, and introducing foam-in-place insulation into the space between the liner and shell. In the preferred embodiment of the invention illustrated, a second foam stop member may be slidably mounted on the tubular member before the liner and cabinet shell are nested for foaming, although this may not be necessary in some instances.

By providing an interfacing, dual foam stop arrangement, considerable misalignment of the liner and cabinet openings is accommodated while not affecting the foam stop action. Further, since the distal portion 19 of the tunnel 18 is accurately positioned with respect to the shell 12 by virtue of the mounting of the tunnel to the shell, as shown in FIG. 3, the tunnel acts as a locating mandrel for obtaining desired positioning of the shell and liner wall members during the manufacturing operation.

The unique cabinet construction 10 effectively minimizes criticality in the spacing between the shell and liner and the alignment of the opening therein for accommodating the wiring tunnel. In addition, the arrangement facilitates rapid assembly of the cabinet as it requires a minimum of parts, fasteners, and the like. As a result, the ease and cost of manufacture are improved, while a positive foam stop is provided in a novel and simple manner.

The foregoing disclosure of specific embodiments is illustrative of the broad inventive concepts comprehended by the invention.

Having described the invention, the embodiments of the invention in which an exclusive property or privilege is claimed are defined as follows:

1. In a cabinet structure having an outer shell, and an inner liner spaced inwardly from the shell to define the insulation space therebetween the improvement comprising:

a wiring tunnel member extending successively through said outer shell, said insulation space, and said liner;

a first foam stop member adjacent said liner in said insulation space, said wiring tunnel member extending through said first foam stop member;

a second foam stop member extending about and bodily movable longitudinally along said wiring tunnel member in said insulation space; and foamed-in-place insulation in said insulation space urging said second foam stop member into engagement with said first foam stop member to cause said foam stop members to cooperatively stop the insulation foam at the extension of said wiring tunnel element through said liner.

2. The cabinet structure of claim 1 including means removably securing said wiring tunnel member to said shell.

3. The cabinet structure of claim 1 wherein said liner defines and opening through which said wiring tunnel member freely extends.

4. The cabinet structure of claim 1 including means fixedly securing said first foam stop member to said liner.

5. The cabinet structure of claim 1 including means sealing said wiring tunnel member to said shell.

6. The cabinet structure of claim 1 wherein said foam stop members comprise generally planar elements formed of open cell polyurethane foam having a thickness substantially less than the width of said insulation space.

7. In a refrigeration apparatus cabinet structure having an outer cabinet shell, inner liner spaced inwardly from said shell to defineds an insulation space therebetween, and aligned openings in said shell and liner, improved means for providing a through passage for wiring or the like, comprising:

a tubular wiring tunnel member having an outwardly extending flange at one end and having a diameter at its opposite end that is substantially smaller than the diameter of said liner opening;

mounting means for mounting said wiring tunnel flange to said outer shell with said flange centered about said shell opening said tunnel member extending inwardly through said insulation space and through said liner wall opening, so as to define a passage through said shell, said insulation space, and said liner;

a sealing gasket disposed between said wiring tunnel flange and said shell;

a first foam stop member comprising a sheetlike piece of flexible open-cell polyurethane foam secured to said liner and overlying said liner opening, said wiring tunnel member extending through said first foam stop member and into said liner opening;

a second foam stop member comprising a sheetlike piece of flexible open-cell polyurethane foam carried about and bodily movable longitudinally along said wiring tunnel adjacent said first foam stop member; and foamed-in-place insulation formed within said insulation space engaging said second foam stop member to urge and retain said second member against said first member to cause said foam stop members to cooperatively stop the insulation foam at the extension of said wiring tunnel element through said liner.

8. The cabinet structure of claim structure of claim 7 wherein said wiring tunnel member defines a flange extending radially inwardly and further including a resilient grommet which snap-fits with said inwardly extending flange to effect a seal between said tunnel member and wiring passage therethrough.

9. The cabinet structure of claim 7 wherein said tubular wiring tunnel member extends inward beyond the inner surface of said liner.

* * * * *